US007444903B1

(12) United States Patent
Li

(10) Patent No.: US 7,444,903 B1
(45) Date of Patent: Nov. 4, 2008

(54) RATCHET WRENCH HAVING REINFORCED STRENGTH

(75) Inventor: Yang-Hua Li, Changhua (TW)

(73) Assignee: Hua Pan Co., Ltd., Changhua (TW)

( * ) Notice: Subject to any disclaimer, the term of this patent is extended or adjusted under 35 U.S.C. 154(b) by 0 days.

(21) Appl. No.: 11/928,197

(22) Filed: Oct. 30, 2007

(51) Int. Cl.
*B25B 13/46* (2006.01)

(52) U.S. Cl. ..... 81/60; 81/63.2

(58) Field of Classification Search ..... 81/60–63.2
See application file for complete search history.

(56) References Cited

U.S. PATENT DOCUMENTS 6,155,140 A * 12/2000 Tsai ..... 81/61
6,216,563 B1 * 4/2001 Hsieh ..... 81/63.2
6,382,052 B1 * 5/2002 Chen ..... 81/63
6,481,315 B1 * 11/2002 Chang et al. ..... 81/60
6,820,520 B2 * 11/2004 Chen ..... 81/60
2007/0101832 A1 * 5/2007 Lee ..... 81/63.1

* cited by examiner

*Primary Examiner*—Hadi Shakeri
(74) *Attorney, Agent, or Firm*—Alan Kamrath; Kamrath & Associates PA

(57) ABSTRACT

A ratchet wrench includes a wrench body provided with a mounting hole and a receiving chamber, a ratchet wheel mounted in the mounting hole of the wrench body and provided with a plurality of ratchet teeth, and a pawl member mounted in the receiving chamber of the wrench body and having a first end provided with a plurality of locking teeth engaged with the ratchet teeth of the ratchet wheel and a second end provided with a sliding face slidable on the ratchet teeth of the ratchet wheel. Thus, the locking teeth of the pawl member are engaged with the ratchet teeth of the ratchet wheel closely and completely, so that the pawl member is combined with the ratchet wheel exactly.

10 Claims, 7 Drawing Sheets

RATCHET WRENCH HAVING REINFORCED STRENGTH

BACKGROUND OF THE INVENTION

1. Field of the Invention

The present invention relates to a ratchet wrench and, more particularly, to a oneway ratchet wrench for operating a workpiece, such as a screw, nut and the like.

2. Description of the Related Art

A conventional ratchet wrench in accordance with the prior art shown in FIGS. 6-9 comprises a wrench body 10 having an end portion 17 provided with a mounting hole 11 and a receiving chamber 15 connected to the mounting hole 11, a ratchet wheel 40 mounted in the mounting hole 11 of the wrench body 10 and having an outer wall provided with a plurality of ratchet teeth 41, a pawl member 20 pivotally mounted in the receiving chamber 15 of the wrench body 10 by a pivot pin 30 and having a first side provided with a plurality of locking teeth 21 engaged with the ratchet teeth 41 of the ratchet wheel 40, an elastic member 23 mounted in the receiving chamber 15 of the wrench body 10 and biased between a peripheral wall of the receiving chamber 15 of the wrench body 10 and a second side of the pawl member 20 to push the pawl member 20 toward the ratchet wheel 40, a retaining ring 800 mounted in the mounting hole 11 of the wrench body 10 and abutting the ratchet wheel 40 to retain the ratchet wheel 40 in the mounting hole 11 of the wrench body 10, and a substantially C-shaped snapping member 900 mounted in the mounting hole 11 of the wrench body 10 and snapped onto the retaining ring 800 to retain the retaining ring 800 in the mounting hole 11 of the wrench body 10.

The wrench body 10 is provided with a positioning hole 16 connected to the receiving chamber 15 to allow passage of the pivot pin 30. The end portion 17 of the wrench body 10 has an inner wall having a first side provided with a receiving groove 13 and a retaining groove 14 each connected to the mounting hole 11 and a second side provided with a limit rib 12. The pawl member 20 is provided with a pivot hole 22 connected to the positioning hole 16 of the wrench body 10 to allow passage of the pivot pin 30. The ratchet wheel 40 has an inner wall provided with a driving hole 42 to drive a workpiece, such as a screw, nut and the like. The ratchet wheel 40 has a first side provided with a limit groove 73 facing the receiving groove 13 of the wrench body 10 and a second side provided with a limit recess 44 abutting the limit rib 12 of the wrench body 10. The retaining ring 800 is mounted on the ratchet wheel 40 and has an inner wall abutting the limit groove 43 of the ratchet wheel 40 and an outer wall abutting the receiving groove 13 of the wrench body 10. The outer wall of the retaining ring 800 is provided with a locking groove 810 facing the retaining groove 14 of the wrench body 10. Thus, the ratchet wheel 40 is limited by the retaining ring 800 and the limit rib 12 of the wrench body 10. The snapping member 900 is snapped into the retaining groove 14 of the wrench body 10 and the locking groove 810 of the retaining ring 800 to retain the retaining ring 800 in the wrench body 10.

In operation, referring to FIG. 8 with reference to FIGS. 6 and 7, the driving hole 42 of the ratchet wheel 40 is mounted on a workpiece (not shown), such as a screw, nut and the like. In such a manner, when the end portion 17 of the wrench body 10 is rotated in the clockwise direction, the pawl member 20 is driven by the wrench body 10 to drive the ratchet wheel 40 in the clockwise direction. At this time, the ratchet wheel 40 applies a reaction force on the pawl member 20 in the counterclockwise direction to drive the locking teeth 21 of the pawl member 20 toward the ratchet teeth 41 of the ratchet wheel 40, while the elastic member 23 pushes the locking teeth 21 of the pawl member 20 toward the ratchet teeth 41 of the ratchet wheel 40, so that the locking teeth 21 at one end of the pawl member 20 are engaged with the ratchet teeth 41 of the ratchet wheel 40 closely, and the locking teeth 21 at the other one end of the pawl member 20 are spaced from the ratchet teeth 41 of the ratchet wheel 40 by pivot action of the pawl member 20 about the pivot pin 30. In such a manner, the pawl member 20 is combined with the ratchet wheel 40. Thus, when the end portion 17 of the wrench body 10 is rotated in the clockwise direction, the pawl member 20 is driven by the wrench body 10 to drive the ratchet wheel 40 in the clockwise direction as shown in FIG. 8 so as to rotate the workpiece in the clockwise direction.

On the contrary, referring to FIG. 9 with reference to FIGS. 6 and 7, when the end portion 17 of the wrench body 10 is rotated in the counterclockwise direction, the pawl member 20 is driven by the wrench body 10 to drive the ratchet wheel 40 in the counterclockwise direction. At this time, the ratchet wheel 40 applies a reaction force on the pawl member 20 in the clockwise direction to push the locking teeth 21 of the pawl member 20 to space from the ratchet teeth 41 of the ratchet wheel 40, while the elastic member 23 is compressed by the pawl member 20, so that the locking teeth 21 of the pawl member 20 are disengaged from the ratchet teeth 41 of the ratchet wheel 40, and the pawl member 20 is released from the ratchet wheel 40 as shown in FIG. 9. Thus, when the end portion 17 of the wrench body 10 is rotated in the counterclockwise direction to drive the pawl member 20 in the counterclockwise direction, the ratchet wheel 40 is released from and not driven by the pawl member 20, so that the wrench body 10 performs an idling rotation in the counterclockwise direction.

However, the locking teeth 21 at one end of the pawl member 20 are engaged with the ratchet teeth 41 of the ratchet wheel 40, and the locking teeth 21 at the other one end of the pawl member 20 are spaced from the ratchet teeth 41 of the ratchet wheel 40 by pivot action of the pawl member 20 about the pivot pin 30, so that the locking teeth 21 at one end of the pawl member 20 are easily worn out or broken during a long-term utilization, thereby decreasing the lifetime of the pawl member 20 and the ratchet wrench. In addition, the force applied on the pawl member 20 is concentrated on the pivot pin 30 to produce a stress concentration, so that the pivot pin 30 easily worn out or broken during a long-term utilization, thereby decreasing the lifetime of the pivot pin 30 and the ratchet wrench.

BRIEF SUMMARY OF THE INVENTION

In accordance with the present invention, there is provided a ratchet wrench, comprising a wrench body having an end portion provided with a mounting hole and a receiving chamber connected to the mounting hole, a ratchet wheel mounted in the mounting hole of the wrench body and having an outer wall provided with a plurality of ratchet teeth, and a pawl member mounted in the receiving chamber of the wrench body and having a first side having a first end provided with a plurality of locking teeth engaged with the ratchet teeth of the ratchet wheel and a second end provided with a sliding face slidable on the ratchet teeth of the ratchet wheel.

The primary objective of the present invention is to provide a ratchet wrench having a reinforced strength.

Another objective of the present invention is to provide a ratchet wrench, wherein the locking teeth of the pawl member are engaged with the ratchet teeth of the ratchet wheel completely, so that the pawl member is combined with the ratchet wheel exactly without incurring detachment, thereby facilitating operation of the ratchet wrench.

A further objective of the present invention is to provide a ratchet wrench, wherein all of the locking teeth of the pawl member are engaged with the ratchet teeth of the ratchet wheel completely, so that the force applied by the locking teeth of the pawl member is shared by all of the locking teeth of the pawl member, and the locking teeth of the pawl member will not be worn out or broken during a long-term utilization, thereby enhancing the lifetime of the pawl member.

A further objective of the present invention is to provide a ratchet wrench, wherein the pawl member is movable freely in the receiving chamber of the wrench body to lock the wrench body and the ratchet wheel so that the rotation force between the wrench body and the ratchet wheel is distributed on the whole pawl member evenly and smoothly without incurring a stress concentration so as to reinforce the strength of the ratchet wrench, thereby preventing the pawl member from being worn out due to a larger rotation force, and thereby enhancing the lifetime of the ratchet wrench.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
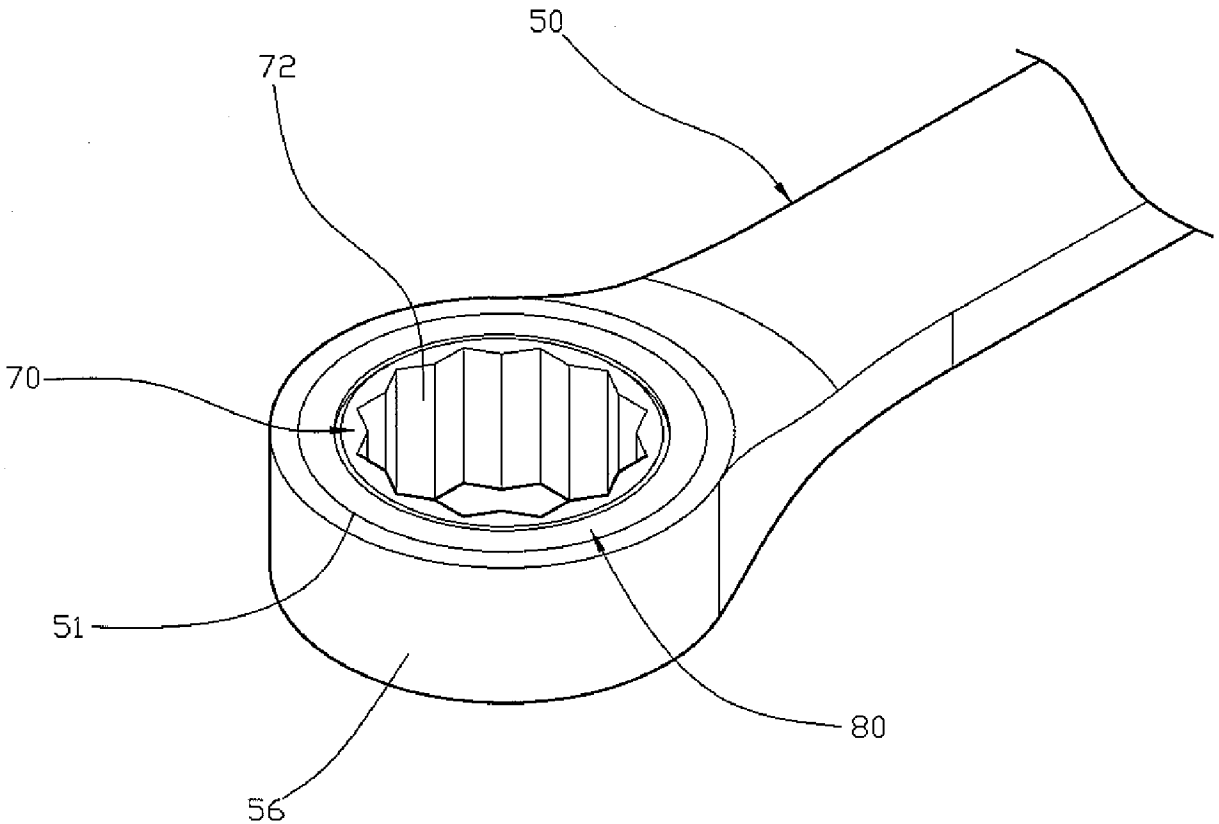
FIG. 1 is a perspective view of a ratchet wrench in accordance with the preferred embodiment of the present invention.

Referring to the drawings and initially to FIGS. 1-4, a ratchet wrench in accordance with the preferred embodiment of the present invention comprises a wrench body 50 having an end portion 56 provided with a mounting hole 51 and a receiving chamber 55 connected to the mounting hole 51, a ratchet wheel 70 mounted in the mounting hole 51 of the wrench body 50 and having an outer wall provided with a plurality of ratchet teeth 71, a pawl member 60 mounted in the receiving chamber 55 of the wrench body 50 and having a first side 65 having a first end provided with a plurality of locking teeth 61 engaged with the ratchet teeth 71 of the ratchet wheel 70 and a second end provided with a sliding face 62 slidable on the ratchet teeth 71 of the ratchet wheel 70, an elastic member 64 mounted in the receiving chamber 55 of the wrench body 50 and biased between a peripheral wall 550 of the receiving chamber 55 of the wrench body 50 and a second side 66 of the pawl member 60 to push the pawl member 60 toward the ratchet wheel 70, a retaining ring 80 mounted in the mounting hole 51 of the wrench body 50 and abutting the ratchet wheel 70 to retain the ratchet wheel 70 in the mounting hole 51 of the wrench body 50, and a snapping member 90 mounted in the mounting hole 51 of the wrench body 50 and snapped onto the retaining ring 80 to retain the retaining ring 80 in the mounting hole 51 of the wrench body 50.

The end portion 56 of the wrench body 50 has an inner wall having a first side provided with a stepped receiving groove 53 and an annular retaining groove 54 each connected to the mounting hole 51 and a second side provided with a radially and inwardly extending limit rib 52. The receiving chamber 55 of the wrench body 50 has a substantially arc-shaped profile.

The pawl member 60 has a substantially arc-shaped profile and is movable freely in the receiving chamber 55 of the wrench body 50 to lock the wrench body 50 and the ratchet wheel 70. The first side 65 of the pawl member 60 is a concave surface, and the second side 66 of the pawl member 60 is a convex surface. The locking teeth 61 of the pawl member 60 are engaged with the ratchet teeth 71 of the ratchet wheel 70 completely and extends through a distance that is half of a length of the first side 65 of the pawl member 60. The sliding face 62 of the pawl member 60 is a recessed smooth surface and also extends through a distance that is half of the length of the first side 65 of the pawl member 60. The second side 66 of the pawl member 60 has an end portion provided with a catch face 63 that is movable to abut the peripheral wall 550 of the receiving chamber 55 of the wrench body 50. The catch face 63 of the pawl member 60 is located adjacent to the locking teeth 61, and the locking teeth 61 of the pawl member 60 are located between the catch face 63 and the sliding face 62.

The elastic member 64 is directed toward the locking teeth 61 and the catch face 63 of the pawl member 60. The elastic member 64 is located adjacent to the sliding face 62 of the pawl member 60, and the sliding face 62 of the pawl member 60 is located between the elastic member 64 and the locking teeth 61 of the pawl member 60.

The ratchet wheel 70 has an inner wall provided with a driving hole 72 to drive a workpiece, such as a screw, nut and the like. The ratchet wheel 70 has a first side provided with a stepped limit groove 73 facing the receiving groove 53 of the wrench body 50 and a second side provided with a stepped limit recess 74 abutting the limit rib 52 of the wrench body 50.

The retaining ring 80 is mounted on the ratchet wheel 70 and has an inner wall abutting the limit groove 73 of the ratchet wheel 70 and an outer wall abutting the receiving groove 53 of the wrench body 50. The outer wall of the retaining ring 80 is provided with a locking groove 81 facing the retaining groove 54 of the wrench body 50. Thus, the ratchet wheel 70 is limited by the retaining ring 80 and the limit rib 52 of the wrench body 50.

The snapping member 90 is substantially C-shaped and is snapped into the retaining groove 54 of the wrench body 50 and the locking groove 81 of the retaining ring 80 to retain the retaining ring 80 in the wrench body 50.

Figure 2:
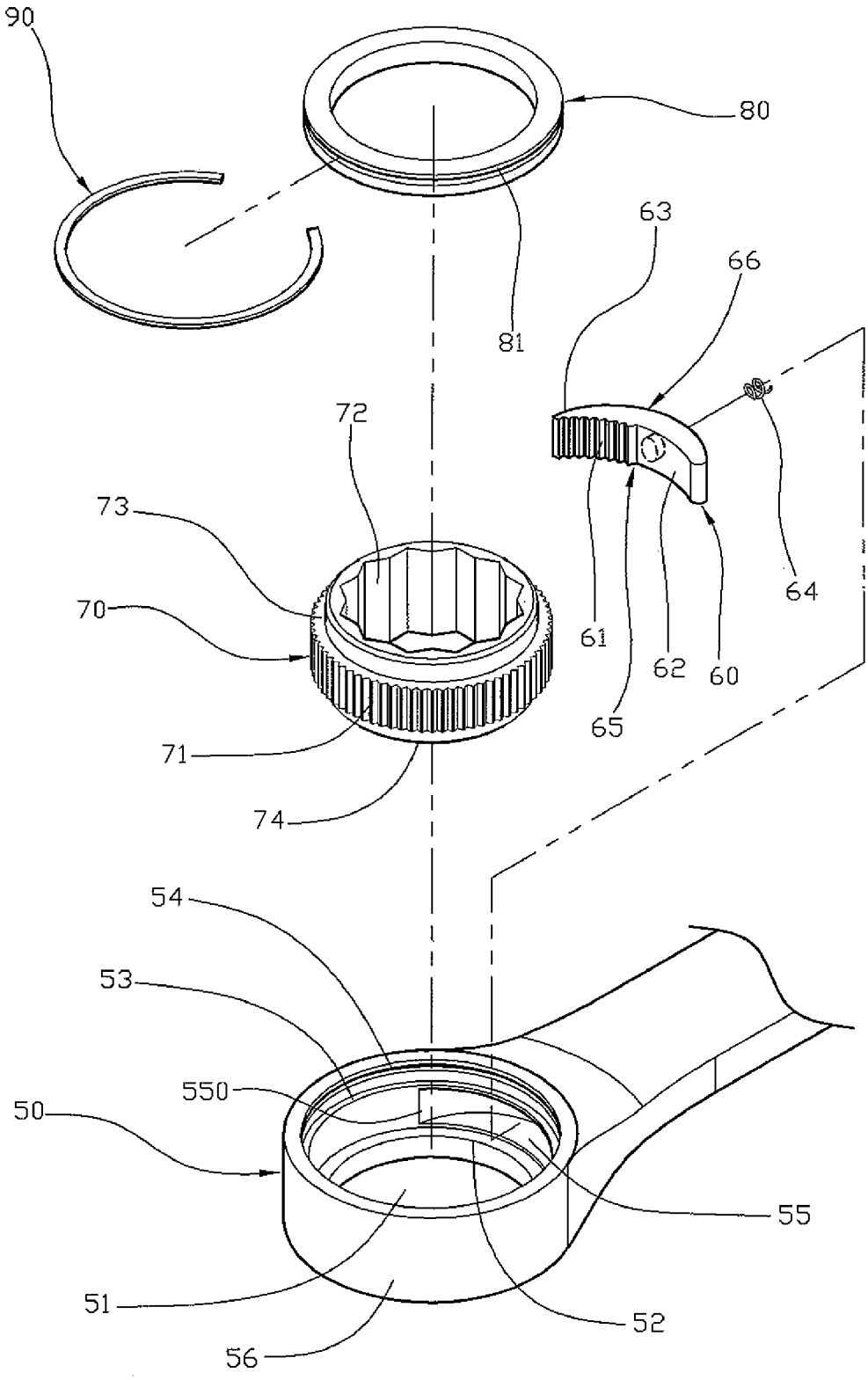
FIG. 2 is an exploded perspective view of the ratchet wrench as shown in FIG. 1.
Figure 3:
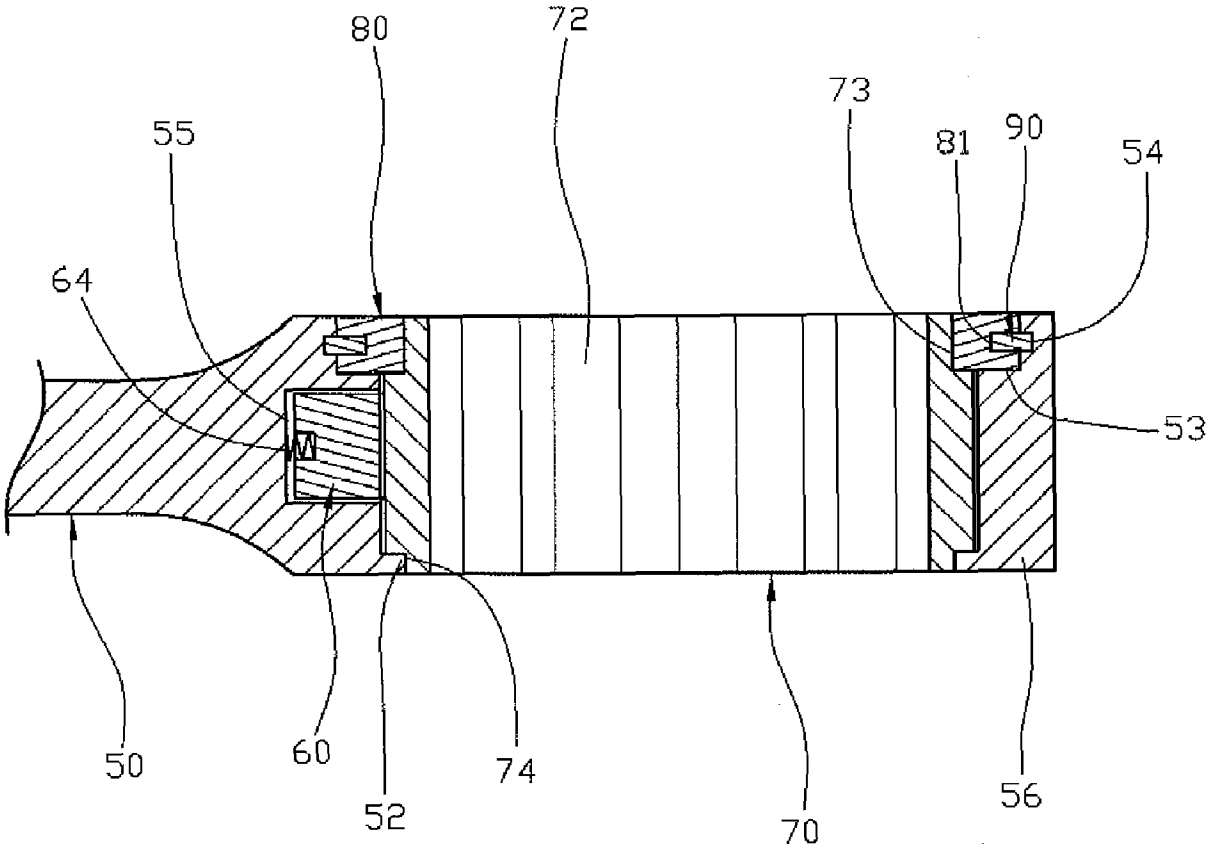
FIG. 3 is a side cross-sectional view of the ratchet wrench as shown in FIG. 1.
Figure 4:
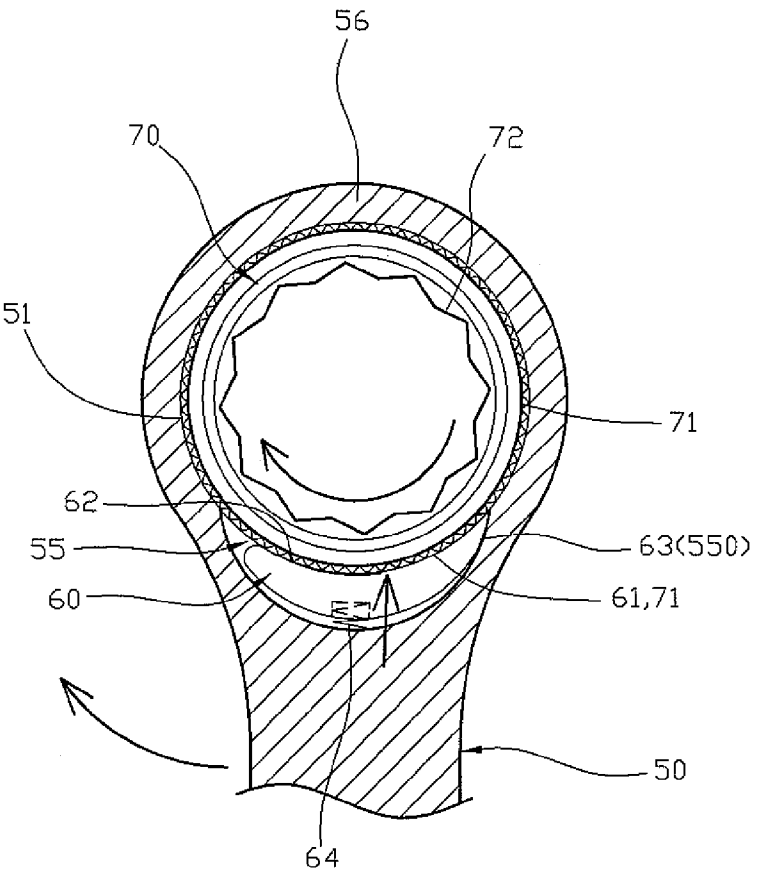
FIG. 4 is a top cross-sectional operational view of the ratchet wrench as shown in FIG. 1.
Figure 6:
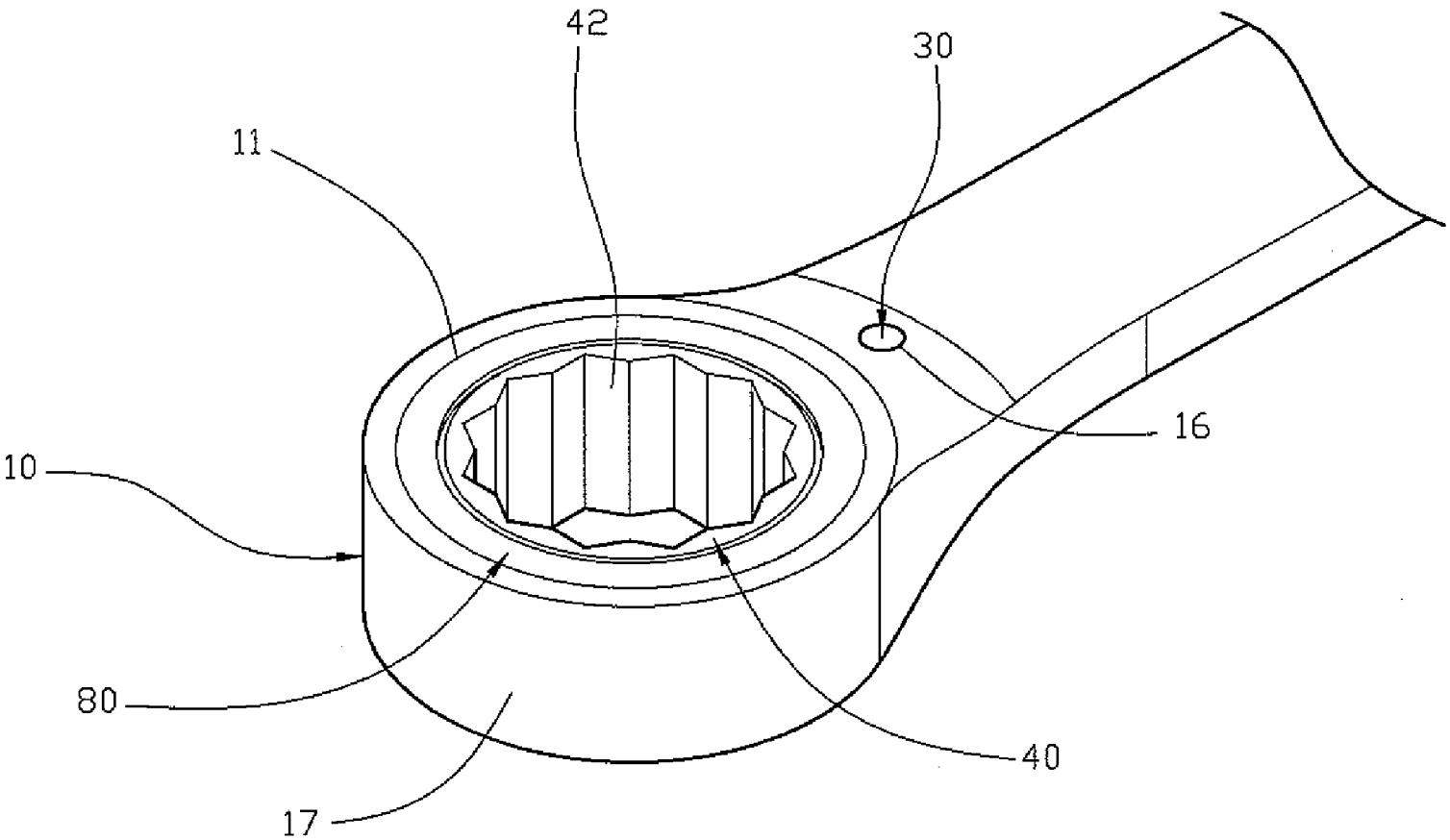
FIG. 6 PRIOR ART
FIG. 6 is a perspective view of a conventional ratchet wrench in accordance with the prior art.
Figure 7:
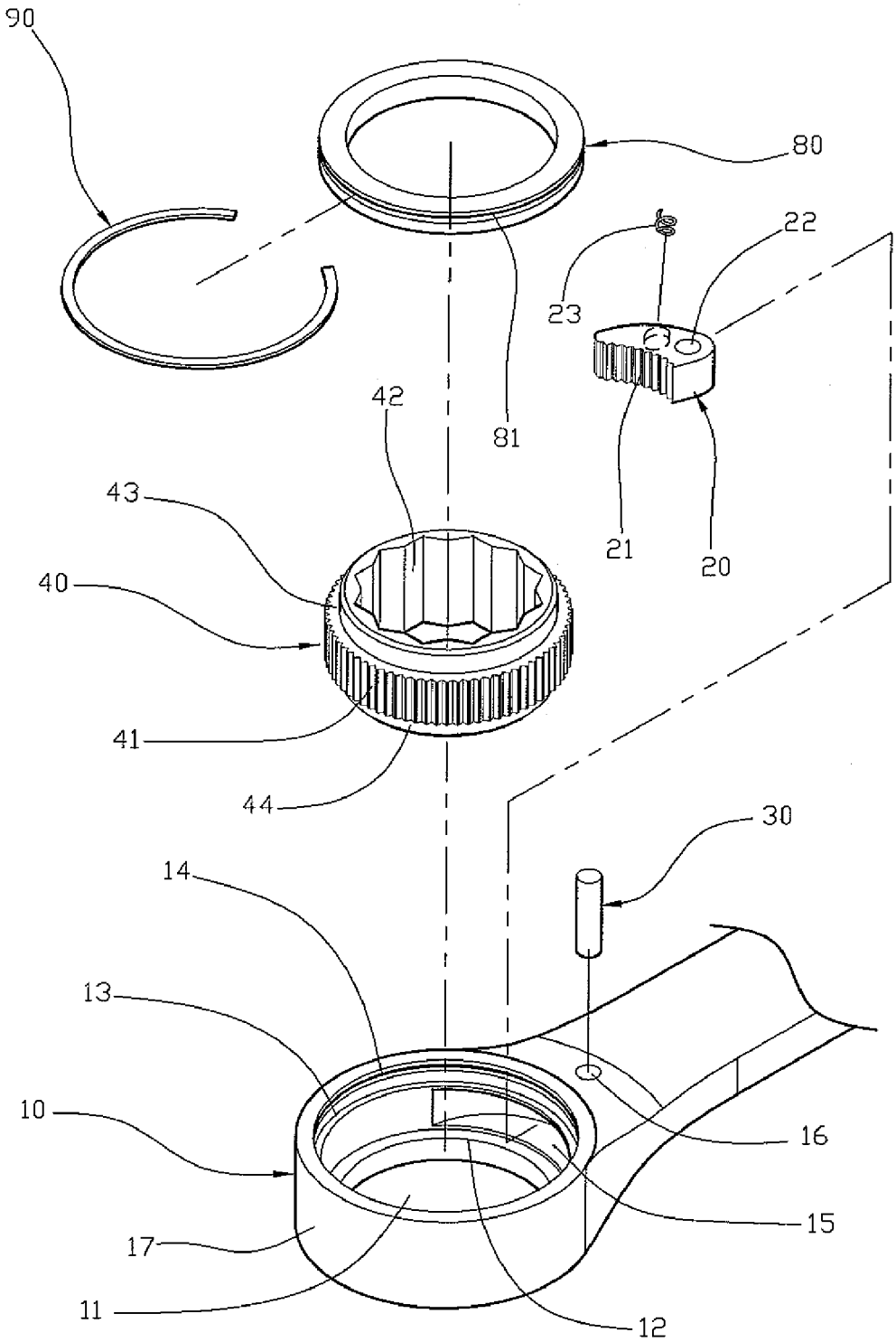
FIG. 7 PRIOR ART
FIG. 7 is an exploded perspective view of the conventional ratchet wrench as shown in FIG. 6.
Figure 9:
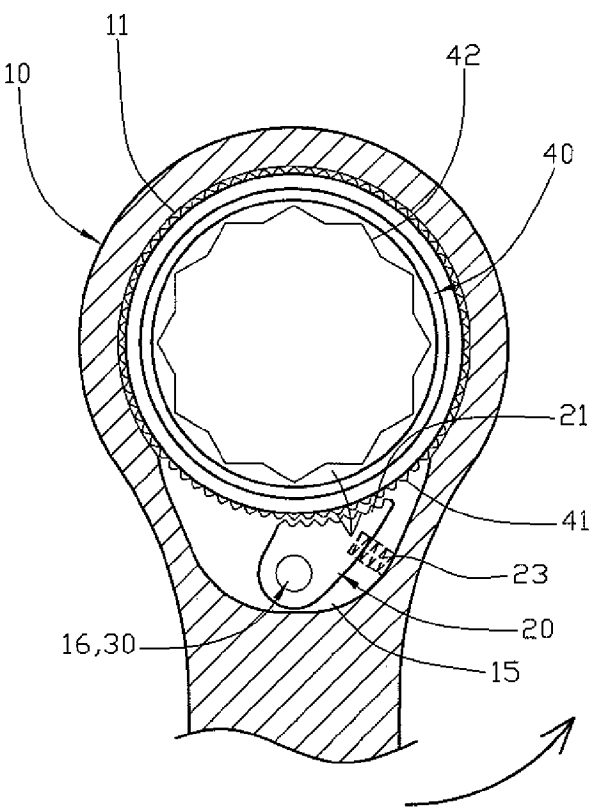
FIG. 9 PRIOR ART
FIG. 9 is a top cross-sectional operational view of the conventional ratchet wrench as shown in FIG. 6.
Figure 8:
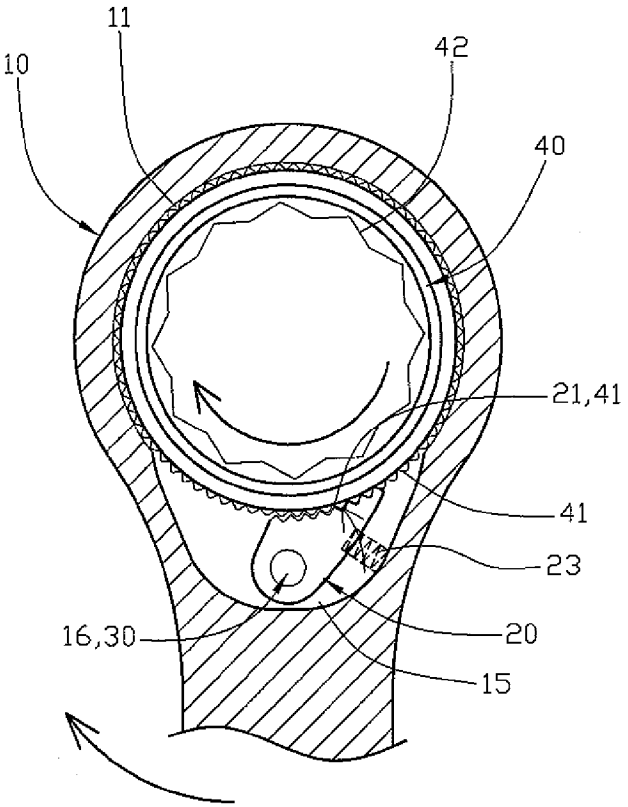
FIG. 8 PRIOR ART
FIG. 8 is a top cross-sectional operational view of the conventional ratchet wrench as shown in FIG. 6.

In operation, referring to FIG. 4 with reference to FIGS. 1-3, the driving hole 72 of the ratchet wheel 70 is mounted on a workpiece (not shown), such as a screw, nut and the like. In such a manner, when the end portion 56 of the wrench body 50 is rotated in the clockwise direction, the pawl member 60 is driven by the wrench body 50 to drive the ratchet wheel 70 in the clockwise direction. At this time, the ratchet wheel 70 applies a reaction force on the pawl member 60 in the counterclockwise direction to drive the locking teeth 61 of the pawl member 60 toward the ratchet teeth 71 of the ratchet wheel 70 and to drive the catch face 63 of the pawl member 60 to press the peripheral wall 550 of the receiving chamber 55 of the wrench body 50, while the elastic member 64 pushes the locking teeth 61 of the pawl member 60 toward the ratchet teeth 71 of the ratchet wheel 70, so that the locking teeth 61 of the pawl member 60 are engaged with the ratchet teeth 71 of the ratchet wheel 70 closely, the sliding face 62 of the pawl member 60 evades the ratchet teeth 71 of the ratchet wheel 70, and the pawl member 60 is combined with the ratchet wheel 70. Thus, when the end portion 56 of the wrench body 50 is rotated in the clockwise direction, the pawl member 60 is driven by the wrench body 50 to drive the ratchet wheel 70 in the clockwise direction as shown in FIG. 4 so as to rotate the workpiece in the clockwise direction.

Figure 5:
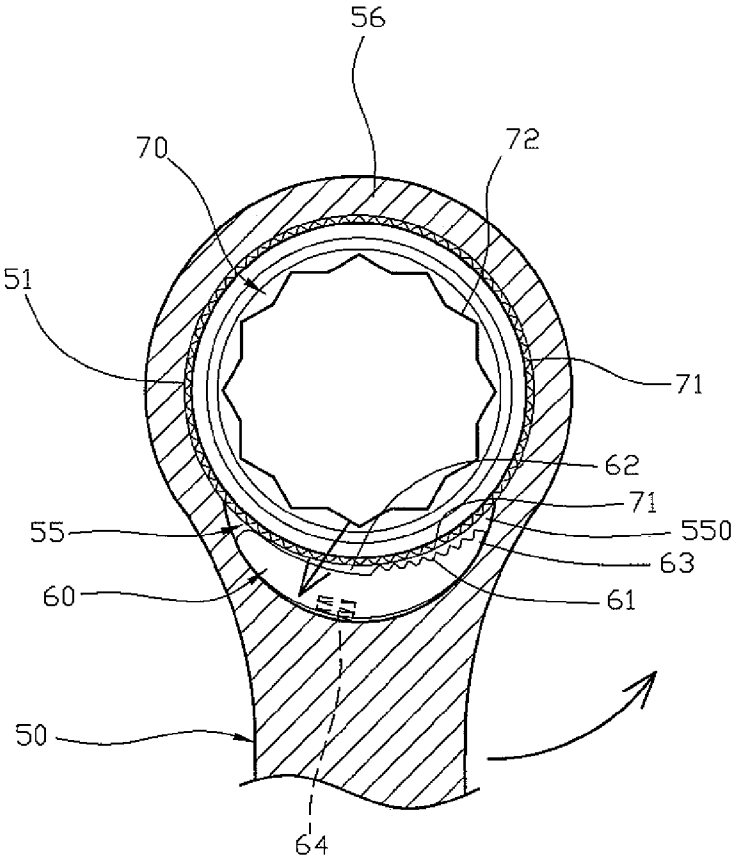
FIG. 5 is a top cross-sectional operational view of the ratchet wrench as shown in FIG. 1.

On the contrary, referring to FIG. 5 with reference to FIGS. 1-3, when the end portion 56 of the wrench body 50 is rotated in the counterclockwise direction, the pawl member 60 is driven by the wrench body 50 to drive the ratchet wheel 70 in the counterclockwise direction. At this time, the ratchet wheel 70 applies a reaction force on the pawl member 60 in the clockwise direction to push the locking teeth 61 of the pawl member 60 to space from the ratchet teeth 71 of the ratchet wheel 70 and to drive the catch face 63 of the pawl member 60 to space from the peripheral wall 550 of the receiving chamber 55 of the wrench body 50, while the elastic member 64 is compressed by the pawl member 60, so that the locking teeth 61 of the pawl member 60 are disengaged from the ratchet teeth 71 of the ratchet wheel 70, the sliding face 62 of the pawl member 60 is movable on the ratchet teeth 71 of the ratchet wheel 70, and the pawl member 60 is released from the ratchet wheel 70 as shown in FIG. 5. Thus, when the end portion 56 of the wrench body 50 is rotated in the counterclockwise direction to drive the pawl member 60, the ratchet wheel 70 is released from and not driven by the pawl member 60, so that the wrench body 50 performs an idling rotation in the counterclockwise direction.

Accordingly, the locking teeth 61 of the pawl member 60 are engaged with the ratchet teeth 71 of the ratchet wheel 70 completely, so that the pawl member 60 is combined with the ratchet wheel 70 exactly without incurring detachment, thereby facilitating operation of the ratchet wrench. In addition, all of the locking teeth 61 of the pawl member 60 are engaged with the ratchet teeth 71 of the ratchet wheel 70 completely, so that the force applied by the locking teeth 61 of the pawl member 60 is shared by all of the locking teeth 61 of the pawl member 60, and the locking teeth 61 of the pawl member 60 will not be worn out or broken during a long-term utilization, thereby enhancing the lifetime of the pawl member 60. Further, the pawl member 60 is movable freely in the receiving chamber 55 of the wrench body 50 to lock the wrench body 50 and the ratchet wheel 70 so that the rotation force between the wrench body 50 and the ratchet wheel 70 is distributed on the whole pawl member 60 evenly and smoothly without incurring a stress concentration so as to reinforce the strength of the ratchet wrench, thereby preventing the pawl member 60 from being worn out due to a larger rotation force, and thereby enhancing the lifetime of the ratchet wrench.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A ratchet wrench, comprising:

a wrench body having an end portion provided with a mounting hole and a receiving chamber connected to the mounting hole;

a ratchet wheel mounted in the mounting hole of the wrench body and having an outer wall provided with a plurality of ratchet teeth;

a pawl member defining a top surface and a bottom surface mounted in the receiving chamber of the wrench body having a first side including a first end provided with a plurality of locking teeth extending from the top surface to the bottom surface engaged with the ratchet teeth of the ratchet wheel successively and completely and a second end provided with a sliding face extending from the top surface to the bottom surface slidable on the ratchet teeth of the ratchet wheel, said first and second ends defining a whole circumferential length of the first side of the pawl member;

an elastic member mounted in the receiving chamber of the wrench body and biased between a peripheral wall of the receiving chamber of the wrench body and a second side of the pawl member to push the pawl member toward the ratchet wheel;

wherein the elastic member is located adjacent to the sliding face of the pawl member and the sliding face of the pawl member is located between the elastic member and the locking teeth of the pawl member;

wherein the first side of the pawl member is a concave surface which extends through the whole circumferential length of the first side of the pawl member;

wherein the sliding face of the pawl member is a concave recessed smooth surface which extends successively and completely through a circumferential length of the second end of the first side of the pawl member that is half of the circumferential length of the first side of the pawl member; and wherein the pawl member is movable relative to the ratchet wheel between a first position where all of the locking teeth of the pawl member are engaged with the ratchet teeth of the ratchet wheel closely and completely, and the sliding face of the pawl member evades the ratchet teeth of the ratchet wheel, and a second position where all of the locking teeth of the pawl member are disengaged from the ratchet teeth of the ratchet wheel, and the sliding face of the pawl member is movable on the ratchet teeth of the ratchet wheel.

2. The ratchet wrench in accordance with claim 1, wherein the receiving chamber of the wrench body has a substantially arc-shaped profile.

3. The ratchet wrench in accordance with claim 2, wherein the pawl member has a substantially arc-shaped profile.

4. The ratchet wrench in accordance with claim 3, wherein the second side of the pawl member is a convex surface.

5. The ratchet wrench in accordance with claim 1, wherein the pawl member is movable freely in the receiving chamber of the wrench body and is movable transversely relative to the ratchet wheel to lock the wrench body and the ratchet wheel.

6. The ratchet wrench in accordance with claim 1, wherein the locking teeth of the pawl member extends through a distance that is half of a circumferential length of the first side of the pawl member.

7. The ratchet wrench in accordance with claim 1, wherein a second side of the pawl member has an end portion provided with a smooth arc-shaped catch face that is movable to abut a peripheral wall of the receiving chamber of the wrench body.

8. The ratchet wrench in accordance with claim 7, wherein the catch face of the pawl member is located adjacent to and connected to the locking teeth; the locking teeth of the pawl member are located between the catch face and the sliding face.

9. The ratchet wrench in accordance with claim 1, wherein the second side of the pawl member has an end portion provided with a smooth arc-shaped catch face that is movable to abut the peripheral wall of the receiving chamber of the wrench body; the elastic member is directed toward the locking teeth and the catch face of the pawl member and is directed opposite to the sliding face of the pawl member.

10. The ratchet wrench in accordance with claim 9, wherein the catch face of the pawl member is located adjacent to and connected to the locking teeth; the locking teeth of the pawl member are located between the catch face and the sliding face.

* * * * *